United States Patent [19]

Hafner

[11] 4,453,671

[45] Jun. 12, 1984

[54] FUEL INJECTION SYSTEM

[75] Inventor: Udo Hafner, Lorch, Fed. Rep. of Germany

[73] Assignee: Robert Bosch GmbH, Stuttgart, Fed. Rep. of Germany

[21] Appl. No.: 344,103

[22] Filed: Jan. 29, 1982

[30] Foreign Application Priority Data

Jan. 29, 1981 [DE] Fed. Rep. of Germany ..... 3102853

[51] Int. Cl.[3] ..... B05B 9/00

[52] U.S. Cl. ..... 239/124; 239/575; 239/585

[58] Field of Search ..... 239/124, 125, 132.5, 239/533.2–533.12, 575, 584, 585, 590.3, DIG. 23

[56] References Cited

U.S. PATENT DOCUMENTS

| | | | |
|---|---|---|---|
| 2,439,257 | 4/1948 | Lum | 239/125 |
| 2,567,818 | 9/1951 | MacCracken | 239/125 |
| 2,921,742 | 1/1960 | Johnsyn, Jr. | 239/124 |
| 3,097,795 | 7/1963 | Simmons | 239/124 |

*Primary Examiner*—John J. Love

*Assistant Examiner*—Michael J. Forman

*Attorney, Agent, or Firm*—Edwin E. Greigg

[57] ABSTRACT

A fuel injection system for internal combustion engines which serves to inject fuel into the air intake tube of the engine. The fuel injection system includes at least one fuel injection valve, which is disposed in a holder body and communicates with a fuel supply line and a fuel discharge line. The fuel injection valve is provided with a fuel supply groove, from which fuel supply openings branch off, and a fuel discharge groove, from which the fuel discharge openings branch off with the fuel supply groove and fuel discharge groove being axially offset linearly from one another. The fuel injection valve is radially guided in the guide opening of the holder body by means of support bodies of a fuel filter, which extends axially over the fuel injection valve, covering the fuel supply groove and the fuel discharge groove. The supply of fuel from the fuel supply line is effected via one filter area to the fuel supply groove, while the fuel can flow out of the fuel discharge groove via another filter area of the fuel filter to the fuel discharge line. The central support body is embodied such that it seals off these filter areas from one another.

7 Claims, 1 Drawing Figure

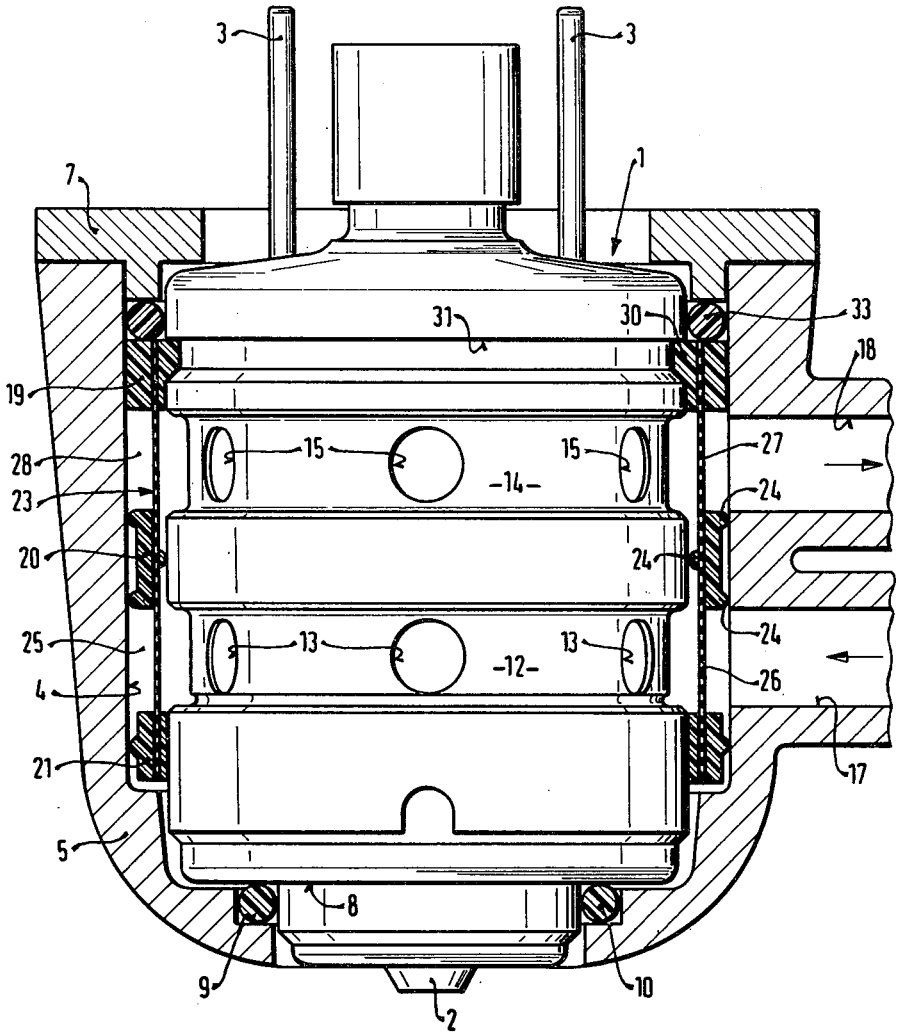
3
3
1
7
31
30
33
18
19
15
15
27
28
-14-
24
23
20
24
25
13
13
24
-12-
26
4
21
17
5
8
9
10
2

FUEL INJECTION SYSTEM

BACKGROUND OF THE INVENTION

The invention is based on a fuel injection system. A fuel injection system is already known in which a portion of the fuel delivered to the fuel injection valve flows at least partially through the fuel injection valve and then back again, via a fuel discharge line, to the intake side of a fuel injection pump. In such a system, however, there is the danger that dirt particles or tiny chips, which may have resulted from the manufacturing process and could not be removed by cleaning, may get into the fuel during operation of the fuel injection system, causing the fuel injection system to malfunction. For example, such particles or chips could be deposited between the armature and core of an electromagnetically actuatable injection valve, or between the movable valve member and the fixed valve seat.

OBJECT AND SUMMARY OF THE INVENTION

The fuel injection system according to the invention has the advantage over the prior art that it is possible to filter the fuel flowing to the injection valve and the discharging fuel as well, yet retaining the maximum possible flow of fuel through the fuel injection valve in order to conduct heat away from the valve. The embodiment of the support body of the fuel filter as a sealing element furthermore permits simpler machining of the circumference of the fuel injection valve and of the guide opening of the holder body.

The primary object of the invention relates to a fuel injection valve which is provided with an exterior body portion having fuel inlet and discharge openings that register with feed lines that are arranged in the holder body in which the valve is positioned. An annular fuel filter having spacedly arranged sealing means encompasses the valve and is interposed between the exterior of the valve and a circumferential wall of the holder body.

A further improvement in the invention is provided by the exterior of the valve being provided with serially arranged grooves and rim means that are arranged along the axis of the valve.

Another object of the invention is to arrange the sealing means that are disposed along the axis of the filter in such a manner that the uppermost seal can abut one of the rims on the valve as well as to snap into a channel provided between the rim and a downwardly extending annular lip of the cover element.

Still another object of the invention is to provide a distinct seal means between the grooved areas on the valve that will channelize the fuel inlet and fuel discharge flow relative to the holder body.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows an exemplary embodiment of the invention in simplified form.

DESCRIPTION OF THE PREFERRED EMBODIMENT

The fuel injection valve 1 shown in the drawing is electromagnetically actuatable in a known manner and serves, for instance, to inject fuel via a mouthpiece 2, in particular at low pressure, into the air intake tube of mixture-compressing internal combustion engines with externally-supplied ignition. The injection of fuel through the fuel injection valve may be effected either simultaneously for all the cylinders of the engine, upstream or downstream of a throttle valve, into the air intake tube by way of a single fuel injection valve or else through separate injection valves into individual air intake tubes directly ahead of each inlet valve of each cylinder of the engine. The electric triggering of the fuel injection valve may be effected in a known manner via contact pins 3. The fuel injection valve is supported in a guide opening 4 of a holder body 5 and may be fixable in the axial direction, for instance, by means of an axially perforated cap 7; a sealing ring 10 rests against an end face 8 of the fuel injection valve, remote from the cap 7, the other end of the ring being supported on a step or shelf 9 of the holder body 5. The holder body 5 may comprise the air intake tube wall itself, or it may be designed as an independent part. The fuel injection valve 1 has an annular fuel supply groove 12, from which fuel supply openings 13 lead into the interior of the fuel injection valve 1. The fuel injection valve 1 likewise has an annularly embodied fuel outflow groove 14 axially offset relative to the fuel supply groove 12 and shown thereabove in the drawing. Fuel outflow openings 15 also lead from the fuel outflow groove 14 into the interior of the fuel injection valve 1. A fuel supply line 17 discharges into the fuel supply groove 12 and communicates with a fuel supply source, such as a fuel pump, in a known manner, but not shown. The fuel flowing into the fuel supply groove 12 by way of the fuel supply line 17 reaches the interior of the fuel injection valve 1 via the fuel inlet openings 13 and is either ejected via the mouthpiece 2 or else, in order to conduct heat away from the valve, flows through the fuel injection valve and enters the fuel discharge groove 14 via the fuel discharge openings 15. The fuel discharge groove 14 communicates with a fuel discharge line 18 embodied within the holder body 5. The fuel injection valve is guided in a radial direction within the guide opening 4 of the holder body 5 by means of elastic support bodies 19, 20, 21 of a fuel filter 23, which extends in an axial direction such that it covers the fuel supply groove 12 and the fuel discharge groove 14. The support bodies 19, 20, 21 are fabricated of some elastic material, such as rubber or plastic. The central support body 20 in particular is embodied in annular fashion such that, provided for instance with sealing protrusions 24, it is supported on the circumference of the fuel injection valve 1 between the fuel supply groove 12 and the fuel discharge groove 14 on the one hand and on the guide opening 4 on the other such that it seals off the fuel supply groove 12 and the fuel supply line 17 relative to the fuel discharge groove 14 and the fuel discharge line 18. The fuel flowing in via the fuel supply line 17 first reaches an annular groove 25 formed between the central support body 20 and the lower end support body 21 of the fuel filter 23, and from there the fuel is capable of flowing via the filter area 26 into the fuel supply groove 12. The fuel can flow via the filter area 27 out of the fuel discharge groove 14 into an annular groove 28 formed between the upper end support body 19 and the central support body 20 of the fuel filter 23; this annular groove 28 being arranged to communicate with the fuel discharge line 18. Particles of dirt which may be in the fuel are filtered out by means of the filter areas 26, 27. Particularly because of the elastic embodiment of the central support body 20, simpler machining and greater tolerances at the circumference of the fuel injection valve 1 and in the diameter of the guide opening 4 can be attained. The upper support body 19 may be provided with an inwardly extending annular protrusion 30 on a wall oriented toward the fuel injection valve 1; this protrusion 30 snaps into a complementally formed annular groove 31 of the fuel injection valve when the fuel filter 23 is mounted on the fuel injection valve, so that the fuel injection valve 1 can be inserted into the guide opening 4 of the holder body 5 together with the mounted fuel filter 23. A sealing ring 33 may likewise be supported axially on the upper support body 19, being disposed between the fuel injection valve 1 and the holder body 5 and fixed in place at the other end by the cap 7.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection system for internal combustion engines having an air intake tube and at least one fuel injection valve, said at least one fuel injection valve having a linear axis with an outer wall surface extending about said axis and surrounded by a separate holder body, said holder body further including an annular wall spaced from said at least one fuel injection valve, a fuel supply inlet line connected to said holder body through which fuel is injectable into said holder body, a fuel discharge line connected to said holder body through which fuel is discharged from said holder body, and an axially aligned mouthpiece through which fuel is ejected into an air intake tube, characterized in that said at least one fuel injection valve has at least one fuel inlet opening in said outer wall surface in registry with said fuel supply inlet line and at least one fuel outflow opening in said outer wall surface of said at least one fuel injection valve in registry with said fuel discharge line provided in said holder body, a single filter element surrounding said at least one fuel injection valve interposed between said at least one fuel injection valve and said annular wall of said holder body and extending across said fuel supply inlet line and said fuel discharge line, said at least one fuel injection valve further including a plurality of axially aligned spaced rims arranged serially along said outer wall surface of said fuel injection valve and plural sealing means on said filter means arranged to engage said wall of said holder body to separate said fuel supply inlet line from said fuel discharge line, and to engage said spaced rims on said fuel injection valve to separate said fuel inlet opening from said fuel outflow opening.

2. A fuel injection system as defined by claim 1, characterized in that each said fuel inlet opening and said outflow openings are confined in annular groove means formed by said spaced serially arranged rims on said fuel injection valve.

3. A fuel injection system as defined by claim 1 characterized in that said fuel injection valve further includes a cover means having an annular lip arranged in spaced relation to one of said rims and one of said sealing means on said filter snaps into a recess between said lip and said rim.

4. A fuel injection system as defined in claim 1, characterized in that said holder body is further provided with an apertured cover, said cover arranged to abut additional sealing means which cooperate with one of said sealing means on said filter.

5. A fuel injection system as defined in claim 2, characterized in that said filter means further includes an annular seal means which forms distinct channel areas between said fuel supply inlet line and said fuel discharge line.

6. A fuel injection system as defined by claim 2, characterized in that one of said rims merges into a channel and at least one of said sealing means in snapped into said channel.

7. A fuel injection system as defined by claim 2, characterized in that said fuel injection valve further includes a cover means having an annular lip arranged in spaced relation to one of said rims and one of said sealing means on said filter snaps into a recess between said lip and said rim.

* * * * *